US011117769B2

(12) United States Patent
Murakami et al.

(10) Patent No.: US 11,117,769 B2
(45) Date of Patent: Sep. 14, 2021

(54) SHEET CONVEYANCE APPARATUS AND IMAGE FORMING APPARATUS INCLUDING THE SAME

(71) Applicant: KONICA MINOLTA, INC., Tokyo (JP)

(72) Inventors: Fumiaki Murakami, Toyokawa (JP); Katsumi Kuroyanagi, Toyokawa (JP); Shigeru Sawano, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 169 days.

(21) Appl. No.: 16/597,130

(22) Filed: Oct. 9, 2019

(65) Prior Publication Data

US 2020/0115178 A1 Apr. 16, 2020

(30) Foreign Application Priority Data

Oct. 10, 2018 (JP) ..... JP2018-191688

(51) Int. Cl.
*B65H 9/00* (2006.01)
*G03G 15/00* (2006.01)

(52) U.S. Cl.
CPC ..... *B65H 9/004* (2013.01); *G03G 15/6567* (2013.01)

(58) Field of Classification Search
CPC ..... B65H 9/004; G03G 15/6567
See application file for complete search history.

(56) References Cited

U.S. PATENT DOCUMENTS 7,823,879 B2 * 11/2010 Vargas ..... B65H 9/004 271/245
8,308,159 B1 * 11/2012 Manor ..... B65H 9/06 271/245
8,328,193 B2 * 12/2012 Ninomiya ..... G03G 15/6567 271/272
8,876,108 B2 11/2014 Uchida et al.
9,193,549 B2 * 11/2015 Fumoto ..... B65H 9/06
2005/0200681 A1 * 9/2005 Nakayama ..... B41J 13/106 347/104

(Continued)

FOREIGN PATENT DOCUMENTS

JP 2013151370 A 8/2013

*Primary Examiner* — Patrick Cicchino
(74) *Attorney, Agent, or Firm* — Holtz, Holtz & Volek PC

(57) ABSTRACT

A sheet conveyance device correcting skew of a sheet being conveyed includes: a rotational shaft extending perpendicularly to a sheet conveyance direction; conveyance rollers disposed at predefined intervals and into which the rotational shaft is inserted; gate members being coaxial with the conveyance rollers and disposed between the conveyance rollers along the rotational shaft, the gate members each having an arc-shaped part partially surrounding the rotational shaft and a stopper protruding radially outwards from the arc-shaped part; and a mounting plate elongated along the rotational shaft and being supported rotatably around the rotational shaft and holding the gate members in a same orientation. After the sheet abuts against at least one of the stoppers, the stoppers are pushed out of the conveyance path by the sheet. When the stoppers are positioned on the conveyance path, openings of the arc-shaped parts face toward a downstream side in the conveyance direction.

7 Claims, 4 Drawing Sheets

(56) References Cited

U.S. PATENT DOCUMENTS

| | | | | |
|---|---|---|---|---|
| 2006/0120781 | A1* | 6/2006 | Ha | G03G 15/6567 399/395 |
| 2013/0161901 | A1 | 6/2013 | Uchida et al. | |
| 2020/0255242 | A1* | 8/2020 | Nagasaki | B65H 29/125 |
| 2020/0369484 | A1* | 11/2020 | Suzuki | B65H 9/06 |

* cited by examiner

SHEET CONVEYANCE APPARATUS AND IMAGE FORMING APPARATUS INCLUDING THE SAME

The entire disclosure of Japanese Patent Application No. 2018-191688, filed on Oct. 10, 2018, is incorporated herein by reference in its entirety.

BACKGROUND

Technological Field

The present disclosure relates to sheet conveyance techniques, and particularly to skew correction mechanisms.

Description of the Related Art

Sheet conveyance apparatuses are mounted on systems for processing sheets such as printing papers and documents, and convey the sheets among processing sections within the systems. Such a system for example includes an image forming apparatus such as a printer and a copier, a post-processing apparatus (finisher), or an automatic document feeder (ADF), and subjects sheets being conveyed to processing such as printing, imaging, sorting, binding, and folding. For appropriate execution of the processing, sheet conveyance apparatuses are required to convey a sheet straight to each element of the processing sections at an appropriate time.

The sheet conveyance apparatuses have functions for keeping sheets straight during conveyance, one of which is skew correction. Skew correction indicates correcting a skew of the leading edge of a sheet relative to a sheet conveyance direction. A known mechanism for implementing this function is a gate resistance method according to which skew correction is performed by a gate disposed on a sheet conveyance path (see for example Japanese Patent Application Publication No. 2013-151370). A gate indicates a movable member having a capability of returning to its original position. A sheet being conveyed pushes the gate out of the conveyance path. After the sheet has passed through, the gate returns onto the conveyance path. When the leading edge of a skew sheet abuts against part of the gate, the sheet firstly rotates around the normal passing through the leading edge of the sheet by a reactive force of the gate. This rotation corrects the skew to enable the leading edge of the sheet to abut against the entire gate. Then, the sheet pushes the gate of the conveyance path to advance.

One possible method for improving the productivity by sheet conveyance is to increase the sheet conveyance speed. Unfortunately, the increase in sheet conveyance speed causes an increased impact on the gate applied from the sheet and thus causes the need for the gate to further ensure skew correction.

Conventional gates have a mechanism using a rotational shaft of conveyance rollers as follows (see Japanese Patent Application Publication No. 2013-151370). This rotational shaft extends perpendicularly to the sheet conveyance direction. As well as conventional ones, the conveyance rollers are disposed at predefined interval, and the rotational shaft is inserted into the conveyance rollers. The gate includes members that are coaxial with the conveyance rollers and are disposed between the conveyance rollers along the rotational shaft (hereinafter, referred to as gate members). The gate members each have a substantially arc-shaped part with a C-shape, an U-shape, an L shape, or the like. This shape facilitates to dispose the gate members between the conveyance rollers along the rotational shaft such that arc shaped parts partially surround the rotational shaft. The gate members each have a stopper protruding radially outwards from the arc-shaped part. The gate members are all held in the same orientation by a single mounting plate. The mounting plate is a member elongated along the rotational shaft and is supported rotatably around the rotational shaft. In accordance with rotation of the mounting plate around the rotational shaft, the stoppers of the gate members are each displaceable between a closed position and an open position. The closed position is on the conveyance path, and the open position is out of the conveyance path. When the stoppers are in the closed positions, the leading edge of the sheet which advances on the conveyance path collides with the stoppers to push the stoppers to the open positions.

According to this structure, openings of the arc-shaped parts of the gate members customarily only need to face toward a direction convenient for assembling. For example, a gate disclosed in Japanese Patent Application Publication No. 2013-151370 includes gate members each having an arc-shaped part whose opening faces toward the upstream side in the conveyance direction when a stopper is positioned in the closed position. Unfortunately, the present inventors' researches found out that this structure is disadvantageous for further ensuring skew correction. Actually, the following tendency is shown by such gate members with arc-shaped parts whose openings face toward the upstream side in the sheet conveyance direction. When the leading edge of a sheet impacts on the stoppers, the gate members rotate not around the rotational shaft but around a contact point between the outer circumferential surface of the rotational shaft and an end portion of the arc-shaped part opposite to the stopper. Rotation of the gate members in this manner brings the stoppers down obliquely relative to the sheet conveyance direction, and thus the leading edge of the sheet deviates from the stoppers to easily float outwards relative to the rotational shaft. Consequently, the gate members apply an insufficient reactive force to the leading edge of the sheet, and thus this structure is difficult to further ensure skew correction.

SUMMARY

The present disclosure aims to solve the above problem, and particularly to provide a sheet conveyance apparatus including gate members that certainly rotate around a rotational shaft of conveyance rollers even upon receiving a strong impact from a sheet.

In order to achieve the above aim, the sheet conveyance apparatus relating to at least one aspect of the present disclosure is a sheet conveyance device that corrects skew of a sheet being conveyed, the sheet conveyance device comprising: a rotational shaft extending perpendicularly to a sheet conveyance direction; conveyance rollers disposed at predefined intervals and into which the rotational shaft is inserted; gate members being coaxial with the conveyance rollers, the gate members being disposed between the conveyance rollers along the rotational shaft, the gate members each having an arc-shaped part and a stopper, the arc-shaped part partially surrounding the rotational shaft, the stopper protruding radially outwards from the arc-shaped part; and a mounting plate elongated along the rotational shaft, the mounting plate being supported rotatably around the rotational shaft and holding the gate members in a same orientation, wherein when the sheet does not abut against the stoppers, the stoppers are positioned on a sheet conveyance path, and after the sheet abuts against at least one of the stoppers, the stoppers are pushed out of the sheet conveyance path by the sheet, and when the stoppers are positioned on the sheet conveyance path, openings of the arc-shaped parts face toward a downstream side in the sheet conveyance direction.

BRIEF DESCRIPTION OF THE DRAWINGS

The advantages and features provided by one or more embodiments of the present disclosure will become more fully understood from the detailed description given hereinbelow and the appended drawings which are given by way of illustration only, and thus are not intended as a definition of the limits of the invention.

In the drawings:

FIG. 4A shows a leading edge of a sheet that has reached one of the gate members, and FIG. 4B shows the sheet that has rotated to a position where the leading edge of the sheet abuts against all the stoppers.

DETAILED DESCRIPTION OF EMBODIMENTS

Hereinafter, one or more embodiments of the present disclosure will be described with reference to the drawings. However, the scope of the invention is not limited to the disclosed embodiments.

[Exterior of Image Forming Apparatus]

Figure 1A:
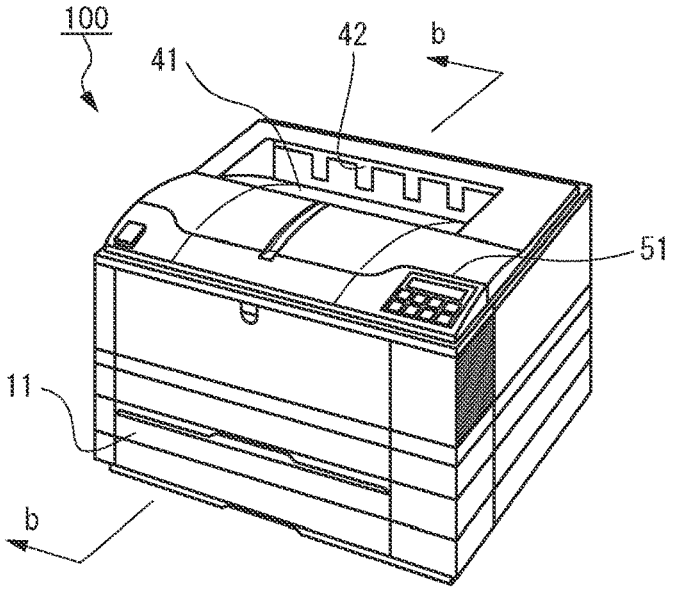
FIG. 1A is a perspective view of an exterior of an image forming apparatus relating to at least one embodiment of the present disclosure.

FIG. 1A is a perspective view of an exterior of an image forming apparatus 100 relating to at least one embodiment of the present disclosure. The image forming apparatus 100 is a printer having a housing with a top surface on which an ejection tray 41 is provided. The ejection tray 41 stores sheets ejected from an ejection slot 42 provided at a far side of the ejection tray 41. An operation panel 51 is embedded in the printer 100 in front of the ejection tray 41. At least one paper cassette 11 is removably attached to the bottom of the printer 100.

[Interior Structure of Image Forming Apparatus]

Figure 1B:
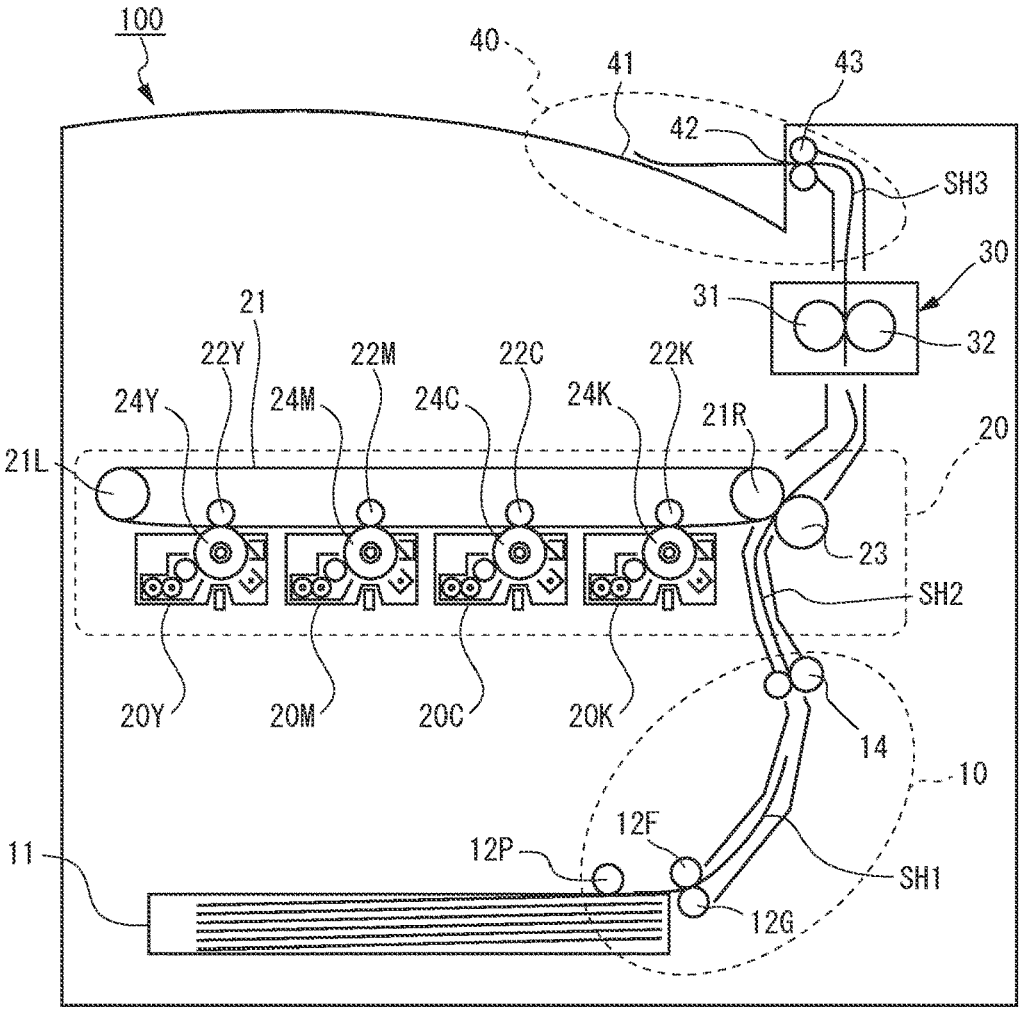
FIG. 1B is a front view of the interior structure of the image forming apparatus.

FIG. 1B is a schematic cross-sectional view of the printer 100 along line b-b in FIG. 1A. The printer 100 is a color printer employing an electrophotographic system, and includes a feeding unit 10, an image forming unit 20, a fixing unit 30, and an ejection unit 40.

First, the feeding unit 10 separates sheets one by one from a stack of sheets stored in the paper cassette 11 using conveyance rollers 12P, 12F, and 12G that are provided for each paper cassette 11. The feeding unit 10 picks up the separated sheet to timing rollers 14. Then, the feeding unit 10 sends out the separated sheet SH1 from the timing rollers 14 to the image forming unit 20 in accordance with an operation timing of the image forming unit 20. Sheets in the present description refer to thin film or thin plate members, products, or printed pieces. Materials of sheets printable by the printer 100 include paper and resin. Types of sheets storable in the paper cassette 11 include plain paper, high-quality paper, color paper, and coated paper. Sizes of the storable sheets include not only standard sizes prescribed by Japanese Industrial Standards (JIS) such as A3 to A7 and B4 to B7 but also sizes of business cards, bookmarks, tickets, post cards, envelopes, and L-size photographs. Furthermore, the sheet orientation can be set to both portrait and landscape.

The image forming unit 20 for example adopts an intermediate transfer system, and includes photoreceptor units 20Y, 20M, 20C, and 20K disposed in tandem, an intermediate transfer belt 21, primary transfer rollers 22Y, 22M, 22C, and 22K, and a secondary transfer roller 23. The intermediate transfer belt 21 extends around a driven pulley 21L and a driving pulley 21R so as to be rotatable therebetween. In a space between the pulleys 21L and 21R, the four photoreceptor units 20Y, 20M, 20C, and 20K and the four primary transfer rollers 22Y, 22M, 22C, and 22K are disposed such that each photoreceptor unit is paired with a corresponding primary transfer roller. Each pair forms therebetween a primary transfer nip with the intermediate transfer belt 21 sandwiched therebetween. The secondary transfer roller 23 and the driving pulley 21R form therebetween a secondary transfer nip with the intermediate transfer belt 21 sandwiched therebetween. A sheet SH2 sent out by the timing rollers 14 is fed through the secondary transfer nip.

While the intermediate transfer belt 21 rotates (counterclockwise in FIG. 1B) to pass the same surface part thereof through the nips, which are formed between the primary transfer rollers 22Y, 22M, 22C, and 22K and photoreceptor units 21Y, 21M, 21C, and 21K, such that respective tone images of yellow (Y), magenta (M), cyan (C), and black (K) colors are formed onto the surface part. Onto the surface part on the intermediate transfer belt 21, which has passed through the four photoreceptor units 21Y, 21M, 21C, and 21K, the respective monochrome toner images of the Y, M, C, and K colors are thus overlapped. Consequently, one color toner image is formed. At the right time the color toner image passes through the secondary transfer nip, the sheet SH2 is fed through the secondary transfer nip from the timing rollers 14. Thus, the color toner image is transferred at the secondary transfer nip from the intermediate transfer belt 21 onto the sheet SH2.

The fixing unit 30 thermally fixes the toner image onto the sheet SH3 sent out from the image forming unit 20. Specifically, the fixing unit 30 feeds the sheet SH3 through a fixing nip formed between the fixing roller 31 and the pressure roller 32 while rotating these rollers. At this time, the fixing roller 31 heats a surface of the sheet SH3 by its incorporated heater, and the pressure roller 32 applies pressure to the heated surface of the sheet SH3 to press the sheet SH3 onto the fixing roller 31. Due to the heat from the fixing roller 31 and the pressure from the pressure roller 32, the toner image is fixed onto the surface of the sheet SH3. The fixing unit 30 further rotates the fixing roller 31 and the pressure roller 32 to send out the sheet SH3 to the ejection unit 40.

The ejection unit 40 ejects the sheet SH3, onto which the toner image has been fused, from the ejection slot 42 to the ejection tray 41. Specifically, the ejection unit 40 rotates ejection rollers 43 provided inside the ejection slot 42 to send the sheet SH3, which has moved from the top portion of the fixing unit 30 to the ejection slot 42, out of the ejection slot 42 such that the sheet SH3 is placed on the ejection tray 41.

[Structure of Sheet Conveyance Apparatus]

A sheet conveyance apparatus is mounted on the printer 100, and includes a driving mechanism for the conveyance rollers 12P, 12F, 12G, and 14 of the feeding unit 10 and a control system therefor. This sheet conveyance apparatus is roughly divided into two units, namely, a sending unit including the conveyance rollers 12P, 12F, and 12G and a composite unit including the timing rollers 14 and a gate.

Sending Unit

The sending unit includes a driving mechanism for the pickup roller 12P and the sheet feed rollers 12F and 12G in pairs and a control system therefor. In particular, the sending unit sets a timing for successively sending out sheets onto the conveyance path, such that a predefined interval is provided between the trailing edge of a preceding sheet that has started to be sent out and a leading edge of the succeeding sheet. In other words, the sending unit sends out each two successive sheets through a sheet feed nip formed between the sheet feed rollers 12F and 12G while providing the predefined interval between the sheets.

Timing Rollers

The timing rollers 14 pass sheets through the secondary transfer nip at an appropriate time. Specifically, the timing rollers 14 are stationary until the sheet SH1 reaches the timing rollers 14 from the paper cassette 11, and the timing rollers 14 temporarily stop the leading edge of the sheet SH1 at a conveyance nip thereof. Then, the timing rollers 14 start rotating in accordance with an instruction from a main controller of the printer 100, to send out the sheet SH2, which has stopped, to the image forming unit 20. The main controller is an electronic circuit (not illustrated) incorporated into the printer 100, and controls a microprocessor such as a central processing unit (CPU) or a micro processing unit (MPU) to execute firmware thereby to send instructions to the elements 10 to 40 of the printer 100. The main controller particularly sets a rotation start timing of the timing rollers 14 based on a time when toner images which have been formed on the surface of the intermediate transfer belt 21 by the photoreceptor units 20Y, 20M, 20C, and 20K pass through the secondary transfer nip. This enables the timing rollers 14 to pass the sheet SH2 through the secondary transfer nip simultaneously with the toner images, resulting in an accurate transfer of the toner images onto the sheet SH2.

Figure 2A:
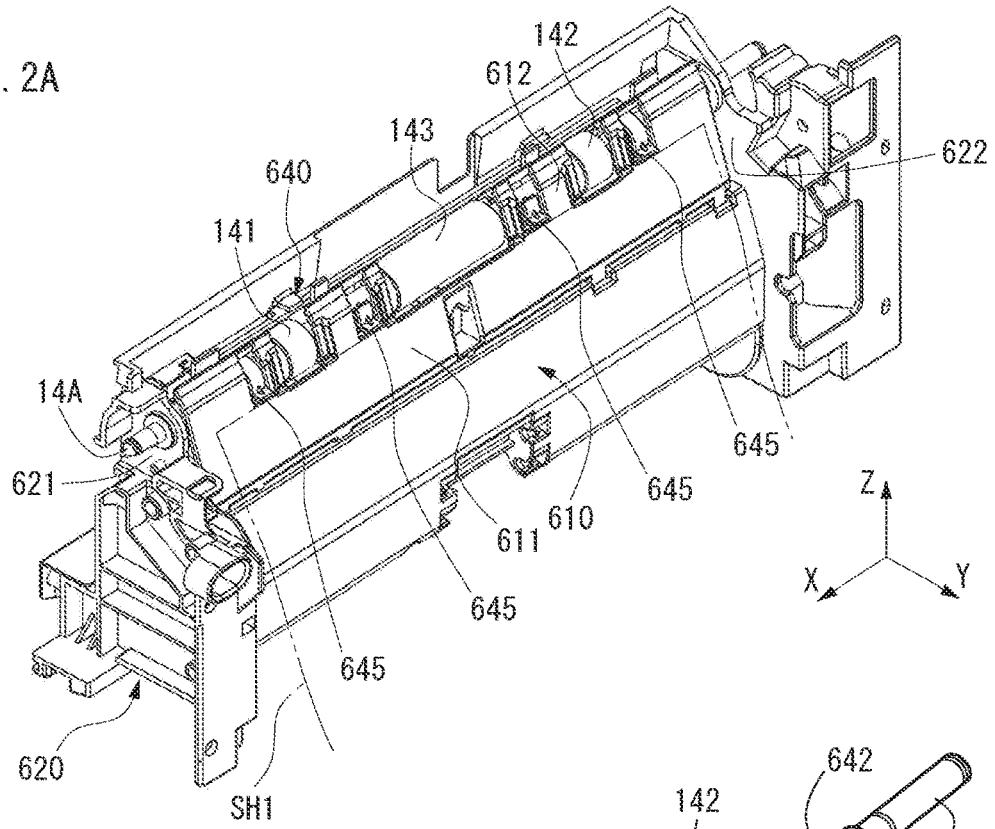
FIG. 2A is a perspective view of an exterior around one of timing rollers seen from one side on a sheet conveyance path.

FIG. 2A is a perspective view of an exterior around one of the timing rollers 14 seen from one side on the sheet conveyance path. The timing roller 14 is composed of three cylindrical parts 141, 142, and 143 (hereinafter, referred to as left roller 141, right roller 142, and central roller 143, respectively) along a rotational shaft 14A thereof, with the identical axis and diameter. The left roller 141 and the right roller 142 are shorter than the central roller 143 in direction of the rotational shaft 14A. The central roller 143 is fixed centrally to the rotational shaft 14A. Meanwhile, the left roller 141 and the right roller 142 are fixed to the rotational shaft 14A so as to be symmetrical about the central roller 143 in the shaft direction. The longitudinal direction of the rotational shaft 14A matches a width direction of the sheet SH1, and the both ends of the rotational shaft 14A in the longitudinal direction are supported by side plates 621 and 622 of a frame 620 such that the rotational shaft 14A is rotatable around a central axis thereof. Note that the width direction indicates a direction of a side of the sheet SH1 perpendicular to the conveyance direction, and is an X-axis direction in FIG. 2A.

The frame 620 is an elongated rod or plate member such as a steel sheet or a rigid resin molding of U-shaped channel type or L-shaped angle type. The frame 620 is disposed outside the three rollers 141-143 relative to the conveyance path of the sheet SH1 (in the negative direction of a Y-axis in FIG. 2A). Specifically, a longitudinal direction of the frame 620 matches the width direction of the sheet SH1 (X-axis direction in FIG. 2A), and the frame 620 is fixed to a chassis (not illustrated) of the printer 100. The side plates 621 and 622 extend from respective ends in the longitudinal direction of the frame 620 toward a direction perpendicular to the longitudinal direction. Further, a downstream end 612 of a paper feed guide 610 is fitted between the side plates 621 and 622.

The paper feed guide 610 is a flat plate member made of metal or rigid resin, and separates off the conveyance path of the sheet SH1. The paper feed guide 610 has a plate surface 611 extending along the conveyance path. The paper feed guide 610 controls the sheet SH1 to slide on the plate surface 611 to guide the sheet SH1 onto the conveyance path.

Gate

A gate 640 is a member that is rotatably attached around the rotational shaft 14A of the timing rollers 14. The gate 640 includes gate members 641-644, a mounting plate 650, and a torsion spring 660. The gate members 641-644 each include a stopper 645 protruding onto the sheet conveyance path. The leading edge of the sheet SH1, which moves toward the conveyance nip of the timing rollers 14, abuts against the stopper 645. The structure of the gate 640 described later causes the stopper 645 to operate as follows. Upon being pressed toward the sheet conveyance direction with a pressing force higher than a restoring force of the torsion spring 660, the stopper 645 recedes from the conveyance path. After the pressing force decreases, the stopper 645 returns onto the conveyance path. Accordingly, when the leading edge of the sheet SH1 abuts against at least one of the stoppers 645, the gate 640 once blocks advance of the leading edge. When the leading edge pushes the stoppers 645 out of the conveyance path, the gate 640 allows the leading edge to advance. With this function, the gate 640 enables skew correction.

Figure 2B:
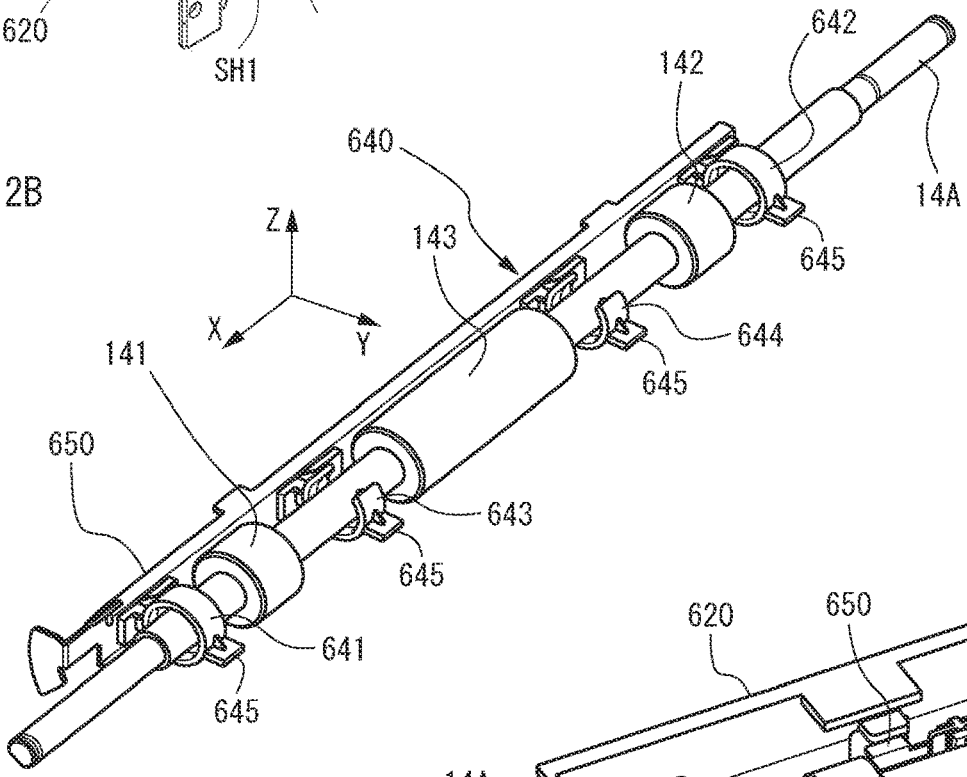
FIG. 2B is a perspective view of the timing roller and a gate extracted from components in FIG. 2A.
Figure 2C:
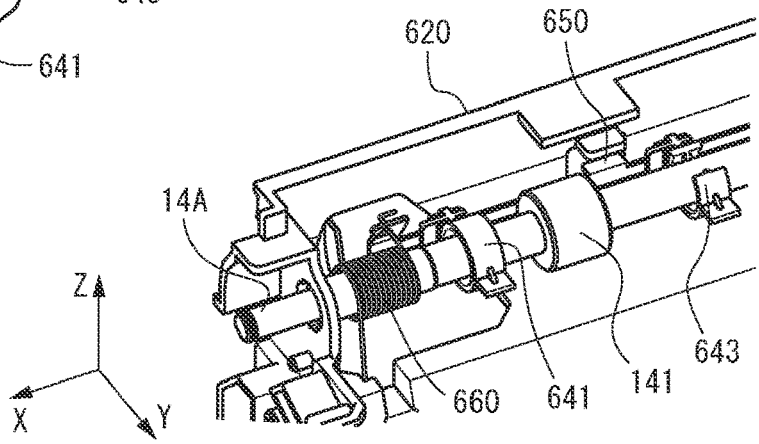
FIG. 2C is an enlarged view of one end of a rotational shaft of the timing roller in FIG. 2A.
Figure 3A:
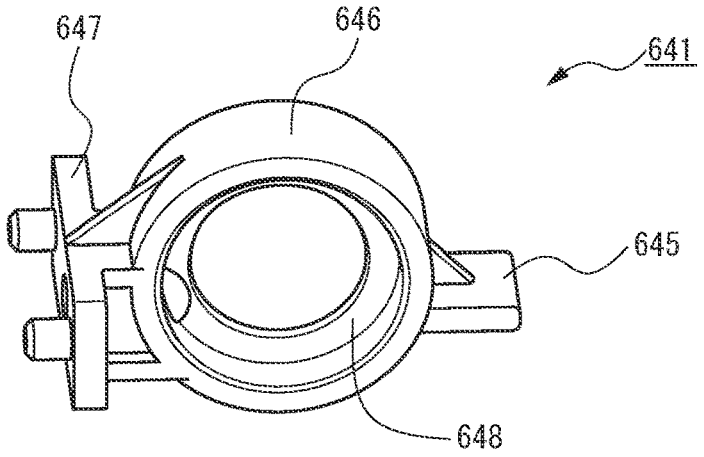
FIG. 3A is a perspective view of a circular gate member located at one end in a longitudinal direction of a rotational shaft.
Figure 3B:
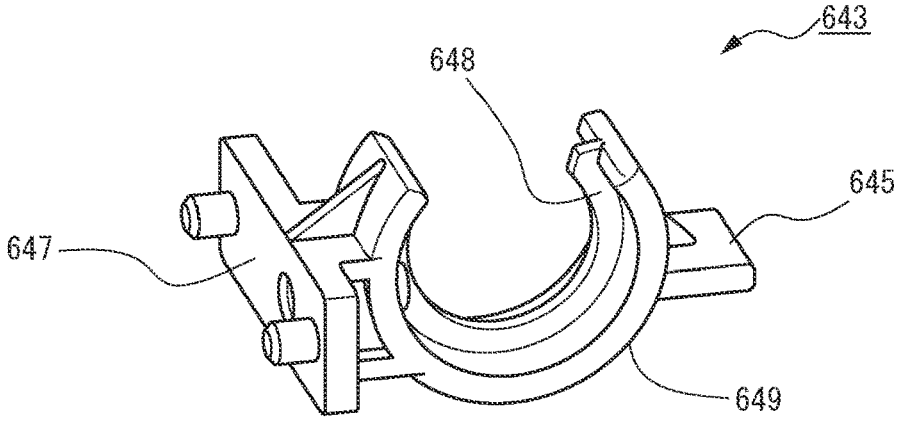
FIG. 3B is a perspective view of a C-shaped gate member located middle in the longitudinal direction of the rotational shaft.

FIG. 2B is a perspective view of the timing roller 14 and the gate 640 extracted from the components in FIG. 2A. FIG. 2C is an enlarged view of the one end of the rotational shaft 14A of the timing roller 14 in FIG. 2A. FIG. 2C shows parts of the timing roller 14 which are behind the paper feed guide 610 in FIG. 2A. FIG. 3A is a perspective view of the gate member 641 which is circular and is located at the one end in the longitudinal direction of the rotational shaft 14A. FIG. 3B is a perspective view of the gate member 643 which is C-shaped and is located at the center in the longitudinal direction of the rotational shaft 14A. Hereinafter, the circular gate member and the C-shaped gate member are respectively referred to as circular member and C-shaped member, into which the four gate members 641-644 are classified. While the circular member 641 is disposed outside the left roller 141 of the timing roller 14 at the one end of the rotational shaft 14A, the circular member 642 is disposed outside the right roller 142 of the timing roller 14 at the other end of the rotational shaft 14A. While the C-shaped member 643 is disposed between the left roller 141 and the central roller 143, the C-shaped member 644 is disposed between the right roller 142 and the central roller 143.

The circular members 641 and 642 are resin moldings with the identical shape and size, each of which include a circular part 646 and a holder 647 in addition to the stopper 645. The circular part 646 is literally a circular part. The inner diameter of the circular part 646 is sufficiently larger than the outer diameter of the rotational shaft 14A, and thus an end part of the rotational shaft 14A can be inserted into a hole of the circular part 646. The circular members 641 and 642 each further include a circular rib 648 extending from the inner circumferential surface of the circular part 646 toward the centroid O of the circular part 646. The inner diameter of the rib 648 is substantially equal to the outer diameter of the rotational shaft 14A. Thus, inserting the rotational shaft 14A into the hole of the circular part 646 brings the inner circumferential surface of the rib 648 into substantially close contact with the outer circumferential surface of the rotational shaft 14A. The circular part 646 has a small contact area with the rotational shaft 14A due to the rib 648 therebetween, and thus receives a low frictional force from the rotational shaft 14A. This enables the circular part 646 to function as a slide bearing for the rotational shaft 14A. In other words, the circular members 641 and 642 are slidable around the rotational shaft 14A. The stopper 645 is a claw protruding radially from the outer circumferential surface of the circular part 646. In accordance with rotation of the circular part 646 around the rotational shaft 14A, the stopper 645 is displaceable between a position on the conveyance path for the sheet SH1 (hereinafter, referred to as closed position) and a position out of the conveyance path (hereinafter, referred to as open position). The holder 647 is a plate-like part. On the opposite side of the centroid O of the circular part 646 relative to the stopper 645, a plate surface of the holder 647 extends toward the tangential direction of the outer circumferential surface of the circular part 646 so as to be connected to the outer circumferential surface.

The C-shaped members 643 and 644 are resin moldings with the identical shape and size, and have the same structure as the circular members 641 and 642 except inclusion of C-shaped parts 649 replaced with the circular parts 646. The C-shaped part 649 is a C-shaped part equivalent to the circular part 646 from which portion has been removed. In particular, the outer diameter of the C-shaped part 649 is equal to the outer diameter of the circular part 646. Meanwhile, the C-shaped part 649 is greater in terms of inner diameter of the rib 648 than the circular part 646. Even after fixing of the rollers 141-143, which constitute the timing roller 14, to the rotational shaft 14A, the C-shaped parts 649 can be fitted to the rotational shaft 14A between the rollers 141-143 so as to partially surround the outer circumferential surface of the rotational shaft 14A.

The mounting plate 650 is an elongated rectangular plate made of metal or rigid resin. The mounting plate 650, parallel to the rotational shaft 14A, is coupled with the holders 647 of the gate members 641-644. This enables the mounting plate 650 to rotate around the rotational shaft 14A together with the gate members 641-644 while holding the gate members 641-644 in the same orientation. In other words, the mounting plate 650 keeps a common angle around the rotational shaft 14A to the gate members 641-644. Furthermore, since the C-shaped part 649 is greater in terms of inner diameter of the rib 648 than the circular part 646, the mounting plate 650 keeps a clearance between the rib 648 included in the C-shaped part 649 and the outer circumferential surface of the rotational shaft 14A. This causes only two members among the gate members 641-644, namely the circular members 641 and 642, to substantially contact the rotational shaft 14A, resulting in a sufficiently low frictional resistance of the gate members 641-644 acting on the rotational shaft 14A.

The torsion spring 660 is made of metal or rigid resin. The one end of the rotational shaft 14A is inserted into the torsion spring 660, and respective ends of the torsion spring 660 are fixed to the frame 620 and the mounting plate 650 (see FIG. 2C). With this structure, when the gate members 641-644 rotate around the rotational shaft 14A together with the mounting plate 650, the torsion spring 660 expands and contracts due to displacement of the mounting plate 650. At this time, the restoring force of the torsion spring 660 acts on the stoppers 645 of the gate members 641-644 in a direction for returning the angle around the rotational shaft 14A from the open positions to the closed positions. The leading edge of the sheet SH1 abuts against at least one of the stoppers 645 positioned in the closed positions. In the case where the leading edge of the sheet SH1 acts a higher force on the stopper 645 than the restoring force of the torsion spring 660, the gate members 641-644 rotate and the stoppers 645 are accordingly pushed to the open positions, which is out of the plate surface 611 of the paper feed guide 610. This allows the leading edge of the sheet SH1 to advance. Meanwhile, in the case where the leading edge of the sheet SH1 acts a lower force on the stoppers 645 than the restoring force of the torsion spring 660, the stoppers 645 stay in the original closed positions to continue to block advance of the leading edge of the sheet SH1.

[Skew Correction by Gate]

Figure 4A:
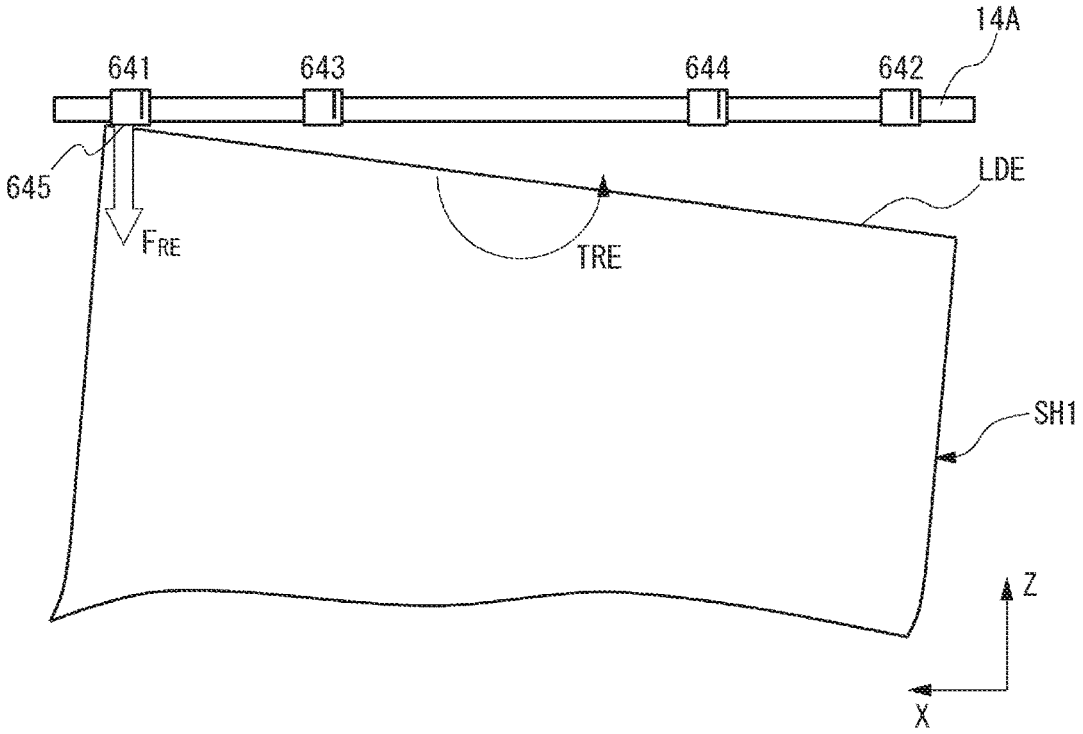
FIGS. 4A and 4B are schematic views of the rotational shaft and the gate members seen in the normal direction of a paper feed guide, where

FIG. 4A is a schematic view of the rotational shaft 14A and the gate members 641-644 seen in the normal direction of the plate surface 611 of the paper feed guide 610, where the leading edge LDE of the sheet SH1 has reached the gate members 641-644. In the case where this sheet SH1 is skew, its leading edge LDE firstly abuts against the stopper 645 of any one of the gate members 641-644, for example the stopper 645 of the circular member 641, which is the leftmost. The leading edge LDE of the sheet SH1 receives a reactive force $F_{RE}$ from the stopper 645, generating a torque TRE around a normal passing through the leading edge LDE (normal of plane of paper in FIG. 4A). Consequently, the sheet SH1 firstly rotates around the normal, which passes through the leading edge LDE, by the reactive force $F_{RE}$ of the stopper 645. Then, the sheet SH1 pushes the stopper, against which the leading edge LDE has abutted, out of the conveyance path.

Figure 4B:
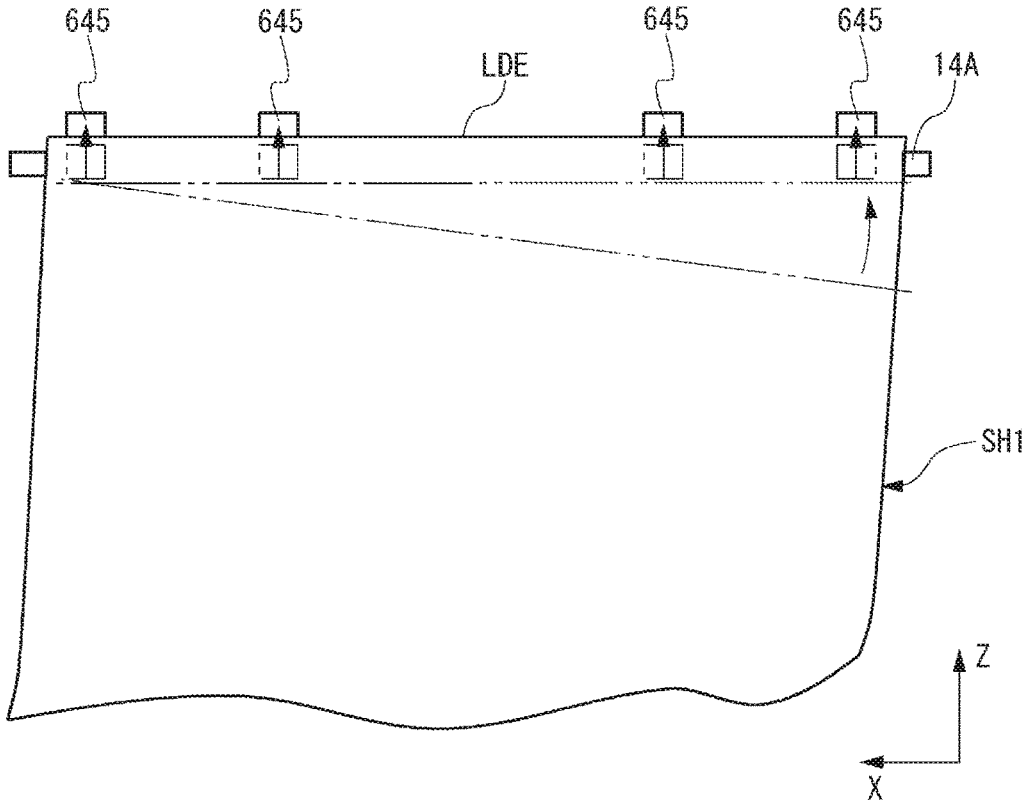

FIG. 4B is a schematic view of the rotational shaft 14A and the gate members 641-644 seen in the normal direction of the plate surface 611 of the paper feed guide 610, where the sheet SH1 has rotated to a position on which the leading edge LDE abuts against all of the stoppers 645 (position on which the leading edge LDE is parallel to the rotational shaft 14A). Since the gate members 641-644 are disposed in the direction (X-axis direction in the figure) perpendicular to the sheet conveyance direction (Z-axis direction in the figure), the skew of the sheet SH1 has been corrected in the figure. Furthermore, when a force of the leading edge LDE acting on the stoppers 645 exceeds the restoring force of the torsion spring 660, the sheet SH1, which has corrected to be straight, pushes the stoppers 645 out of the conveyance path to advance.

[Orientation of C-Shaped Members]

Figure 3C:
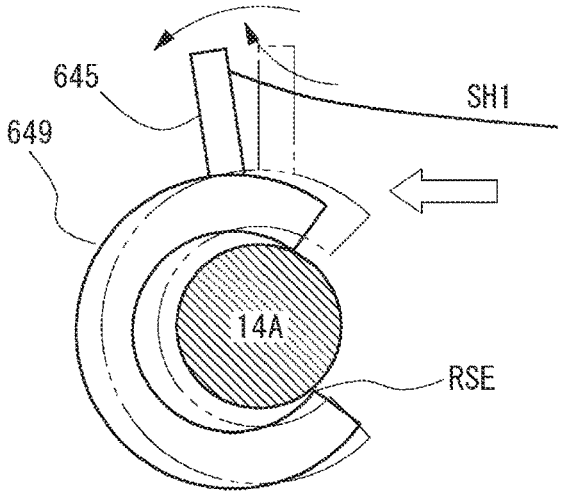
FIG. 3C is a side schematic view of the C-shaped gate member whose arc-shaped part has an opening that faces toward the upstream side in a sheet conveyance direction.

FIG. 3C is a side schematic view of the C-shaped gate members 643 and 644, where the C-shaped part 649 has the opening that faces toward the upstream side in the conveyance direction for the sheet SH1 (toward the positive Z-axis direction in the figures). Note that the C-shaped part 649 relating to the present embodiment actually has the opening that faces toward the opposite orientation, namely toward the downstream side in the conveyance direction. When the leading edge LDE of the sheet SH1 abuts against at least one of the stoppers 645, the mounting plate 650 bends due to an impact from the leading edge LDE, displacing the C-shaped part 649 toward the sheet conveyance direction (positive Z-axis direction). With the openings facing toward the upstream side in the sheet conveyance direction, the C-shaped part 649 can displace in a wide range while keeping the inner circumferential surface of the rib 648 from colliding with the outer circumferential surface of the rotational shaft 14A. In particular, the stopper 645 contacts the leading edge LDE of the sheet SH1 at a point away from the center of the C-shaped part 649, generating a torsional stress in the holder 647. This causes the inner circumferential surface of the rib 648 to collide with the outer circumferential surface of the rotational shaft 14A at an end RSE of the C-shaped part 649 opposite to the stopper 645. Consequently, the C-shaped part 649 easily rotates around this collision point. The rotation of the C-shaped part 649 in this manner brings the stopper 645 down obliquely relative to the sheet conveyance direction for the sheet SH1 (positive Z-axis direction). Consequently, the leading edge LDE of the sheet SH1 easily turns off the stopper 645 to rise outwards relative to the rotational shaft 14A. Thus, the stoppers 645 applies an insufficient reactive force for skew correction to the leading edge LDE of the sheet SH1.

Figure 3D:
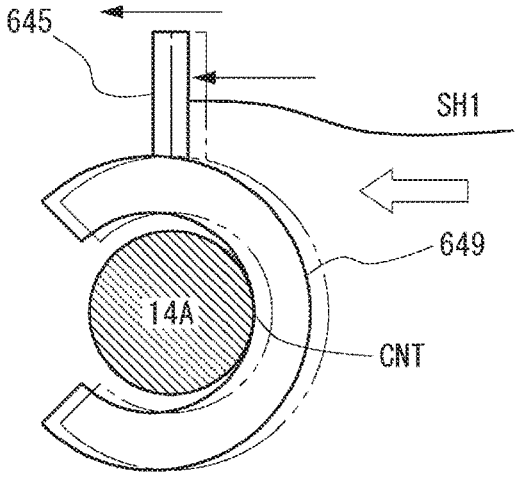
FIG. 3D is a side schematic view of the C-shaped gate member whose arc-shaped part has an opening that faces toward the downstream side in the sheet conveyance direction.

FIG. 3D is another side schematic view of the C-shaped gate members 643 and 644, where the C-shaped part 649 has the opening that faces toward the actual orientation, namely toward the downstream side in the conveyance direction for the sheet. When the leading edge LDE of the sheet SH1 abuts against at least one of the stoppers 645, the C-shaped part 649 can displace in a narrow range while keeping the inner circumferential surface of the rib 648 from colliding with the outer circumferential surface of the rotational shaft 14A. This causes a center portion CNT of the inner circumferential surface of the rib 648 to collide with the outer circumferential surface of the rotational shaft 14A with no torsion of the mounting plate 650. Thus, the stopper 645 actually only displaces to be parallel to the sheet conveyance direction (Z-axis direction), keeping the leading edge LDE of the sheet SH1 from deviating from the stopper 645. This effect is exhibited by the four gate members 641-644, ensuring skew correction on the sheet SH1.

Advantages of Embodiment

According to the sheet conveyance apparatus relating to the above embodiment of the present disclosure, when the stoppers are positioned in the closed position, the openings of the C-shaped parts of the C-shaped gate members 643 and 644 face toward the downstream side in the sheet conveyance direction. With this structure, when the leading edge LDE of the sheet SH1 abuts against the stoppers 645, the center portion CNT of the inner circumferential surface of the rib 648 collides with the outer circumferential surface of the rotational shaft 14A with no torsion of the mounting plate 650. Thus, the stopper 645 actually only displaces to be parallel to the sheet conveyance direction (Z-axis direction), keeping the leading edge LDE of the sheet SH1 from deviating from the stopper 645. This enables the gate members 641-644 of the sheet conveyance apparatus to surely rotate around the rotational shaft 14A even upon receiving a strong impact from the sheet SH1. This ensures skew correction on the sheet SH1.

[Modifications]

(A) The image forming apparatus 100 in FIG. 1, on which the sheet conveyance apparatus relating to the above embodiment of the present disclosure is mounted, is a printer. Alternatively, the sheet conveyance apparatus relating to at least one embodiment of the present disclosure may be mounted on a single function peripheral (SFP) such as a copier and a facsimile, or a multifunction peripheral (MFP). Also, the apparatus, on which the sheet conveyance apparatus is mounted, may perform the print function employing an inkjet system instead of the electrophotographic system. Further alternatively, the sheet conveyance apparatus relating to at least one embodiment of the present disclosure may be mounted on any system for processing sheets such as a finisher and an ADF.

(B) The holders 647 of the gate members 641-644 are press-fitted to the mounting plate 650, fixing the gate members 641-644 to the mounting plate 650. Alternatively, the gate members 641-644 may be fixed to the mounting plate 650 with screws or an adhesive. Further alternatively, the gate members 641-644 may be integrally formed with the mounting plate 650 for example by rigid resin.

(C) The C-shaped members 643 and 644 each have the C-shaped part 649 in the shape of a circular arc. It suffices that the central angle of the circular arc is large enough for the C-shaped part 649 to be fitted to the rotational shaft 14A. Also, the C-shaped part 649 is not limited to be C-shaped. The C-shaped part 649 may have any arc shape such as a U-shape whose portion contacts the outer circumferential surface of the rotational shaft 14A on the upstream side in the sheet conveyance direction upon receiving an impact from a sheet. Further, after being fitted to the rotational shaft 14A, the C-shaped members 643 and 644 each may additionally include any member that closes the ends of the C-shaped parts 649.

(D) The gate members 641-644 have the ribs 648 extending from the inner circumferential surfaces thereof. However, this structure is not essential. The gate members 641-644 may omit the ribs 648 as long as a coefficient of friction is sufficiently low between the inner circumferential surface of the gate members 641-644 and the outer circumferential surface of the rotational shaft 14A.

(E) The circular members 641 and 642 function both as the gate controlling the movement of sheets and as the slide bearing for the rotational shaft 14A. Alternatively, the circular members 641 and 642 may function only as the slide bearing for the rotational shaft 14A, without including the stoppers 645. In this case, the circular members 641 and 642 may be disposed out of the sheet conveyance path. Moreover, the circular members 641 and 642 themselves may be omitted as long as the stability of the gate 640 is sufficiently high with only the C-shaped members 643 and 644.

[Outline]

The sheet conveyance apparatus relating to at least one embodiment of the present disclosure is a sheet conveyance device that corrects skew of a sheet being conveyed, the sheet conveyance device comprising: a rotational shaft extending perpendicularly to a sheet conveyance direction; conveyance rollers disposed at predefined intervals and into which the rotational shaft is inserted; gate members being coaxial with the conveyance rollers, the gate members being disposed between the conveyance rollers along the rotational shaft, the gate members each having an arc-shaped part and a stopper, the arc-shaped part partially surrounding the rotational shaft, the stopper protruding radially outwards from the arc-shaped part; and a mounting plate elongated along the rotational shaft, the mounting plate being supported rotatably around the rotational shaft and holding the gate members in a same orientation, wherein when the sheet does not abut against the stoppers, the stoppers are positioned on a sheet conveyance path, and after the sheet abuts against at least one of the stoppers, the stoppers are pushed out of the sheet conveyance path by the sheet, and when the stoppers are positioned on the sheet conveyance path, openings of the arc-shaped parts face toward a downstream side in the sheet conveyance direction.

According to at least one embodiment, each of the gate members and the rotational shaft have a clearance therebetween.

According to at least one embodiment, the gate members each further have a rib extending from an inner circumferential surface of the arc-shaped part toward the rotational shaft.

According to at least one embodiment, the sheet conveyance device further comprises a pair of cylindrical bearing members that are fixed to end parts in a longitudinal direction of the mounting plate, and bear the rotational shaft, wherein the rotational shaft is coaxially and rotatably inserted into the bearing members.

According to at least one embodiment, the bearing members each have a stopper protruding radially outwards from an outer circumferential surface thereof in a direction in which the stoppers of the gate members protrude, and when the sheet does not abut against the stoppers of the gate members, the stoppers are positioned on the sheet conveyance path, and after the sheet abuts against at least one of the stoppers, the stoppers are pushed out of the sheet conveyance path by the sheet.

According to at least one embodiment, the bearing members may further have a rib extending from an inner circumferential surface thereof toward the rotational shaft.

The image forming device relating to at least one embodiment of the present disclosure is an image forming device comprising: a sheet conveyance device that corrects skew of a sheet being conveyed; and an image forming unit that forms an image on the sheet conveyed by the sheet conveyance device, wherein the sheet conveyance device comprises: a rotational shaft extending perpendicularly to a sheet conveyance direction; conveyance rollers disposed at predefined intervals and into which the rotational shaft is inserted; gate members being coaxial with the conveyance rollers, the gate members being disposed between the conveyance rollers along the rotational shaft, the gate members each having an arc-shaped part and a stopper, the arc-shaped part partially surrounding the rotational shaft, the stopper protruding radially outwards from the arc-shaped part; and a mounting plate elongated along the rotational shaft, the mounting plate being supported rotatably around the rotational shaft and holding the gate members in a same orientation, when the sheet does not abut against the stoppers, the stoppers are positioned on a sheet conveyance path, and after the sheet abuts against at least one of the stoppers, the stoppers are pushed out of the sheet conveyance path by the sheet, and when the stoppers are positioned on the sheet conveyance path, openings of the arc-shaped parts face toward a downstream side in the sheet conveyance direction.

According to the above sheet conveyance apparatus, when the stoppers are positioned in the closed position, the arc-shaped parts of the gate members face toward the downstream side in the sheet conveyance direction. This surely enables the gate members of this sheet conveyance apparatus to rotate around the rotational shaft of the conveyance roller even upon receiving a strong impact from a sheet.

Although embodiments of the present invention have been described and illustrated in detail, the disclosed embodiments are made for purposes of illustration and example only and not limitation. The scope of the present invention should be interpreted by terms of the appended claims.

What is claimed is:

1. A sheet conveyance device that corrects skew of a sheet being conveyed, the sheet conveyance device comprising:

a rotational shaft extending perpendicularly to a sheet conveyance direction;

conveyance rollers disposed at predefined intervals and into which the rotational shaft is inserted;

gate members being coaxial with the conveyance rollers, the gate members being disposed between the conveyance rollers along the rotational shaft, the gate members each having an arc-shaped part and a stopper, the arc-shaped part partially surrounding the rotational shaft, the stopper protruding radially outwards from the arc-shaped part; and a mounting plate elongated along the rotational shaft, the mounting plate being supported rotatably around the rotational shaft and holding the gate members in a same orientation, wherein when the sheet does not abut against the stoppers, the stoppers are positioned on a sheet conveyance path, and after the sheet abuts against at least one of the stoppers, the stoppers are pushed out of the sheet conveyance path by the sheet, and when the stoppers are positioned on the sheet conveyance path, openings of the arc-shaped parts face toward a downstream side in the sheet conveyance direction.

2. The sheet conveyance device of claim 1, wherein each of the gate members and the rotational shaft have a clearance therebetween.

3. The sheet conveyance device of claim 2, wherein the gate members each further have a rib extending from an inner circumferential surface of the arc-shaped part toward the rotational shaft.

4. The sheet conveyance device of claim 1, further comprising a pair of cylindrical bearing members that are fixed to end parts in a longitudinal direction of the mounting plate, and bear the rotational shaft, wherein the rotational shaft is coaxially and rotatably inserted into the bearing members.

5. The sheet conveyance device of claim 4, wherein the bearing members each have a stopper protruding radially outwards from an outer circumferential surface thereof in a direction in which the stoppers of the gate members protrude, and when the sheet does not abut against the stoppers of the gate members, the stoppers are positioned on the sheet conveyance path, and after the sheet abuts against at least one of the stoppers, the stoppers are pushed out of the sheet conveyance path by the sheet.

6. The sheet conveyance device of claim 5, wherein the bearing members each further have a rib extending from an inner circumferential surface thereof toward the rotational shaft.

7. An image forming device comprising:

a sheet conveyance device that corrects skew of a sheet being conveyed; and an image forming unit that forms an image on the sheet conveyed by the sheet conveyance device, wherein the sheet conveyance device comprises:

a rotational shaft extending perpendicularly to a sheet conveyance direction;

conveyance rollers disposed at predefined intervals and into which the rotational shaft is inserted;

gate members being coaxial with the conveyance rollers, the gate members being disposed between the conveyance rollers along the rotational shaft, the gate members each having an arc-shaped part and a stopper, the arc-shaped part partially surrounding the rotational shaft, the stopper protruding radially outwards from the arc-shaped part; and a mounting plate elongated along the rotational shaft, the mounting plate being supported rotatably around the rotational shaft and holding the gate members in a same orientation, when the sheet does not abut against the stoppers, the stoppers are positioned on a sheet conveyance path, and after the sheet abuts against at least one of the stoppers, the stoppers are pushed out of the sheet conveyance path by the sheet, and when the stoppers are positioned on the sheet conveyance path, openings of the arc-shaped parts face toward a downstream side in the sheet conveyance direction.

* * * * *